United States Patent [19]

Powers et al.

[11] Patent Number: 4,601,796

[45] Date of Patent: Jul. 22, 1986

[54] HIGH REFLECTANCE SEMI-SPECULAR ANODIZED ALUMINUM ALLOY PRODUCT AND METHOD OF FORMING SAME

[75] Inventors: John H. Powers, Lower Burrell; Hang T. Dang, Plum Boro, both of Pa.

[73] Assignee: Aluminum Company of America, Pittsburgh, Pa.

[21] Appl. No.: 754,573

[22] Filed: Jul. 15, 1985

Related U.S. Application Data

[63] Continuation-in-part of Ser. No. 651,912, Sep. 19, 1984, which is a continuation of Ser. No. 590,323, Mar. 16, 1984, Pat. No. 4,483,750.

[51] Int. Cl.[4] ..... C25D 5/44

[52] U.S. Cl. ..... 204/33; 204/29; 204/58

[58] Field of Search ..... 204/58, 29, 33

[56] References Cited

U.S. PATENT DOCUMENTS

| | | | |
|---|---|---|---|
| 3,671,333 | 6/1972 | Mosier | 148/6.27 |
| 3,720,508 | 3/1973 | Brock et al. | 75/147 |
| 4,225,399 | 9/1980 | Tomita | 204/58 |
| 4,252,620 | 2/1981 | Tomita | 204/58 |

FOREIGN PATENT DOCUMENTS 1439933 6/1976 United Kingdom .

OTHER PUBLICATIONS

Al Assn. Alloy Designations 9-1-76.

*Primary Examiner*—R. L. Andrews
*Attorney, Agent, or Firm*—Andrew Alexander; John P. Taylor

[57] ABSTRACT

The invention comprises a highly reflective anodized aluminum alloy product consisting essentially of 0.25 to 1.5 wt. % magnesium with the balance aluminum anodized in a DC anodizing bath containing at least 26% sulfuric acid at a current density of at least 18 amperes per square foot at a temperature of at least 60° F.

22 Claims, 2 Drawing Figures

HIGH REFLECTANCE SEMI-SPECULAR ANODIZED ALUMINUM ALLOY PRODUCT AND METHOD OF FORMING SAME

CROSS-REFERENCE TO RELATED APPLICATIONS

This application is a continuation-in-part of application Ser. No. 651,912, filed Sept. 19, 1984 as a continuation of application Ser. No. 590,323, filed Mar. 16, 1984 now U.S. Pat. No. 4,483,750.

BACKGROUND OF THE INVENTION

1. Technical Field of the Invention

This invention relates to an aluminum alloy product. More particularly, this invention relates to an improved aluminum alloy product having a highly reflectorized surface thereon.

2. Description of the Prior Art

Highly reflective surfaces, including both specular and semi-specular reflective surfaces, have been produced on an aluminum material utilizing various techniques including proper selection of the alloy constituents, bright rolling or mechanical polishing of the aluminum surface, and processing of the highly polished or bright rolled surface in a brightening bath which may comprise either electrobrightening or chemical brightening. The highly reflective surface so produced is then protected by anodizing the aluminum to provide a thin, transparent, protective layer of aluminum oxide on the surface as is well known to those skilled in the art.

Various attempts at improving the reflectivity of the product have been proposed through the years. One approach is to vary the type of brightener used to treat the aluminum surface prior to anodizing. Typical of such an approach is the aluminum phosphate chemical brightening bath disclosed in U.S. Pat. No. 3,530,048 which uses a combination of aluminum phosphate, nitric acid, phosphoric acid and copper sulfate. The brightened aluminum surface, according to the patentees, is then anodized in a sulfuric acid bath having a concentration of from 12 to 20 wt. % at a temperature of 70° to 80° F. using a current of about 10 to 15 amperes per square foot.

It is also known to vary the alloy constituents to improve the reflectivity of the aluminum surface. U.S. Pat. No. 3,720,508 discloses an aluminum alloy used in the production of a highly reflective aluminum surface which contains from 0.5 to 3% magnesium, from 0.2 to 0.5% silver, from 0.001 to 0.2% iron and from 0.001 to 0.15% silicon. It is, of course, also known that excellent reflectance may be obtained from high purity aluminum. However, the cost of such a material is prohibitive. Such materials are also more difficult to work with metallurgically as well, i.e., controlling grain size, etc. Furthermore, as will be illustrated, the production of a semi-specular or milky reflective finish requires the presence of other metals such as iron not present in high purity aluminum.

The provision of additives in the anodizing bath to attempt to improve the bright or reflective surface of aluminum is also known. For example, U.S. Pat. No. 3,671,333 provides for the addition of a natural or synthetic hydrophilic colloid to the reflective aluminum surface during anodizing of the aluminum by adding the colloid to the anodizing bath. Surface coatings produced during the anodization are alleged to be much thinner and apparently more compact than previous anodized aluminum coatings which, the patentees allege, is believed to be due to the larger molecule of the colloid forming as a colloidate on the reflective surface which apparently compacts the aluminum oxide formed. The thinner coating is then alleged to provide better reflectivity while eliminating the disadvantages of a thin normal anodized coating.

Other attempts at varying the anodization process include the use of AC anodizing using a sulfuric acid bath as shown in British Pat. No. 1,439,933. High current densities of 1 to 10 amperes per square decimeter (about 10 to 90 amperes per square foot) are proposed in U.S. Pat. No. 4,252,620 for use with a highly concentrated sulfuric acid anodizing bath containing 40 to 60% sulfuric acid and oxalic acid or nickel sulfate to produce a porcelain-like texture although no improvement in reflectivity is alleged or apparently desired by the patentee.

In our parent patent application Ser. No. 590,323 and its continuation application Ser. No. 651,912, we described and claimed a novel process for the production of aluminum reflector material having a higher total reflectance value than previously attainable. The process comprises controlling the anodizing conditions of an aluminum alloy by immersing the alloy in a DC anodizing bath containing at least 26 wt. % sulfuric acid and anodizing the sheet at a current density of at least 18 amperes per square foot at a temperature of at least 60° F.

Now, we have discovered that our process can produce an even higher reflectance when it is used in combination with control of the alloy constituents in the aluminum reflector material.

SUMMARY OF THE INVENTION

It is, therefore, an object of this invention to provide an improved highly reflective anodized aluminum alloy product.

It is another object of this invention to provide an improved highly reflective anodized aluminum alloy product by controlling the amount of silicon and iron in the alloy to improve the reflectance of the resulting product.

It is a further object of this invention to provide an improved highly reflective anodized aluminum alloy product by essentially excluding copper and manganese from the alloy to increase the reflectance of the resulting product.

It is yet a further object of this invention to provide an improved highly reflective anodized aluminum alloy product by essentially excluding copper and manganese from the alloy while controlling the anodizing parameters to increase the reflectance and brightness of the resulting product.

These and other objects of the invention will be apparent from the description of the preferred embodiments and the accompanying flowsheet.

In accordance with the invention, an improved aluminum alloy reflective product is provided which comprises an aluminum alloy, having a magnesium content of 0.25 to 1.5 wt. % with the balance consisting essentially of aluminum, which is anodized in a DC anodizing bath containing at least 26 wt. % sulfuric acid and at a current density of at least 18 amperes per square foot and at a temperature of at least 60° F.

DESCRIPTION OF THE PREFERRED EMBODIMENT

Figure 1:
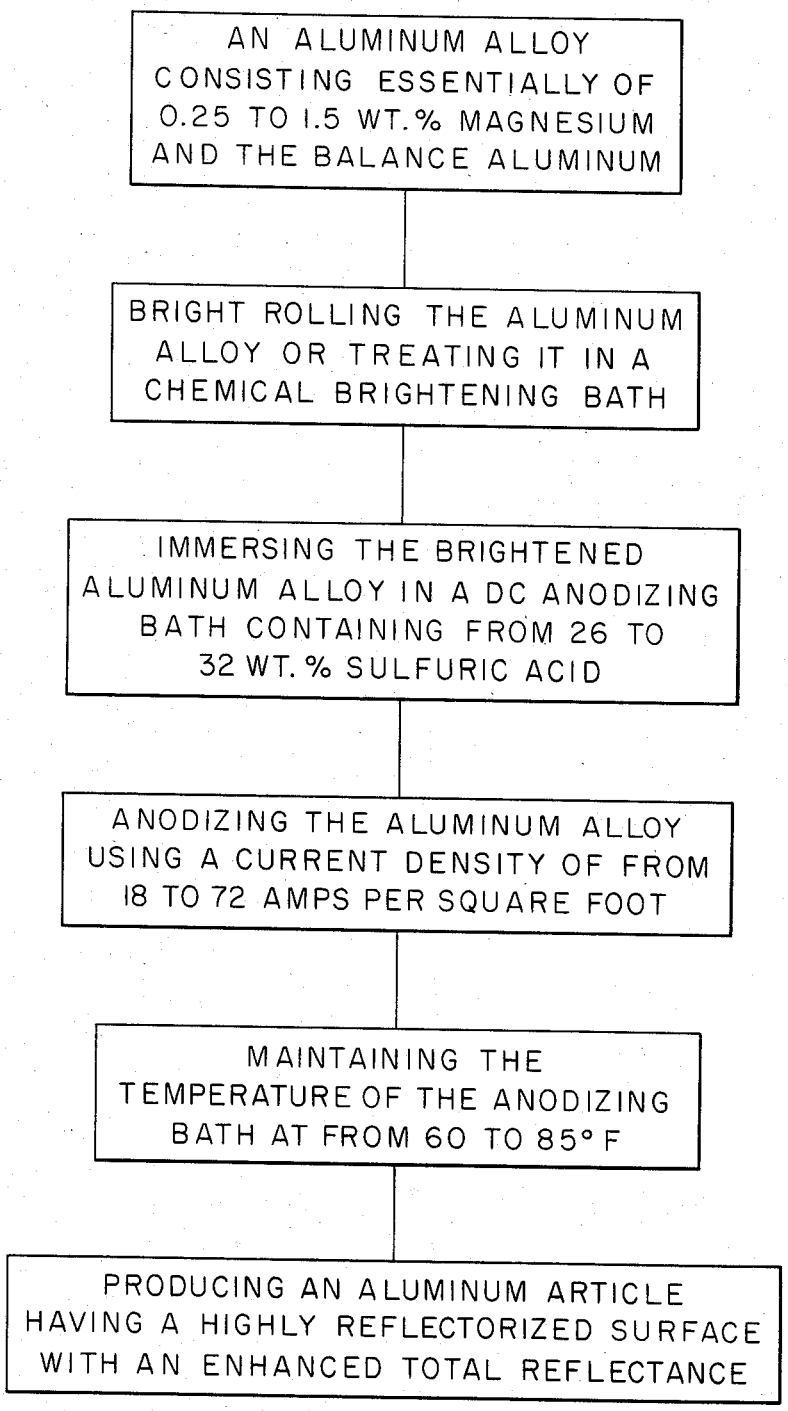
FIG. 1 is a flow sheet illustrating the practice of the invention.

In accordance with the invention, an improved highly reflective semi-specular anodized aluminum material is produced from an aluminum alloy which contains essentially only magnesium as an alloying additive. The alloy is either conventionally bright rolled at the plant or else is first mechanically finished or polished to provide a smooth surface. Optionally, the material may then be treated in a brightening bath which may comprise a chemical brightener or an electro brightener. When a chemical brightening step is used, it may also be desirable to subsequently etch the brightened surface in a phosphoric acid etch. The polished and brightened aluminum surface is then anodized in accordance with the invention to provide the desired highly reflective semi-specular surface.

The use of the term "semi-specular" herein is intended to define a diffuse or milky finish as opposed to a specular finish. A reflector surface which will reflect, at an angle of 15° to the reflectance angle as measured on a goniophotometer, at least 0.08% of the light reflected at the reflectance angle is referred to as a semi-specular reflector finish.

The aluminum alloy used in accordance with the invention consists essentially of from 0.25 to 1.5 wt. % magnesium and the balance aluminum. No manganese or copper is added as an alloying additive. The maximum amount of copper, manganese, iron and silicon which may be tolerated as impurities is no more than 0.05 wt. % copper, no more than 0.01 wt. % manganese and no more than 0.50 wt. % of either iron or silicon. Preferably, the aluminum alloy used in accordance with the invention consists essentially of from 0.65 to 0.80 wt. % magnesium with the balance aluminum and no more than from 0.10 to 0.20 wt. % iron, 0.07 to 0.13 wt. % silicon, 0 to 0.01 wt. % copper and 0 to 0.01 wt. % manganese present as impurities.

The aluminum alloy material used to form the highly reflective product may comprise as-rolled sheet or may be subjected to any conventional mechanical polishing techniques as are well known to those skilled in the art. As stated above, if desired the aluminum material may be subjected to a conventional chemical brightening step. However, it has been found that the highly reflective anodized aluminum alloy product of the invention may be formed with only a mechanical bright rolling step prior to anodizing. If the chemical brightening step is used, it may comprise a chemical brightener, such as the Alcoa 5 chemical brightening which comprises the use of a hot mixture of 85% phosphoric acid and 70% nitric acid which is initially mixed in a 19:1 volumetric ratio, although this ratio will change during use due to accumulation of aluminum phosphate in the solution. If a chemical brightening step is used, it may be desirable to subsequently etch the brightened surface in a 30–40% phosphoric acid etch for from ¼ to 1 minute to insure formation of the desired semi-specular finish.

The aluminum surface, brightened by either bright rolling or chemical brightening, is then anodized to provide a protective layer of aluminum oxide over the brightened aluminum surface. In accordance with one aspect of the invention, a sulfuric acid anodizing bath is used having a concentration of from 26 to 32 wt. % sulfuric acid, preferably 28 to 32 wt. % sulfuric acid. The temperature of the bath during anodizing is maintained, in accordance with the invention, at from about 60° to 84° F., preferably 67° to 84° F., and most preferably about 73° to 75° F.

The reflective aluminum material is subjected to DC anodizing in the sulfuric acid bath, i.e., anodizing using direct current with the reflective aluminum material serving as the anode, while maintaining a current density of at least 18 amperes per square foot, preferably from 27 to 72 amperes per square foot, and most preferably, from 30 to 45 amperes per square foot during the time of anodizing.

After anodizing, the reflector material is rinsed in water and the anodized coating is sealed by immersion in hot (95° C.) deionized water or a nickel acetate solution for about 5 minutes and then removed and dried. Other, more involved, sealing techniques may be used, but may not be necessary.

The total reflectance of the anodized reflector may then be measured using an integrating sphere type total reflectometer, such as Dianos TRI Reflectometer, which was used to produce the total reflectance data in Examples I, II and III below. Reflective materials, anodized in accordance with the invention, have total reflectance values usually over 82%, and in some instances, over 85%.

We do not wish to be bound by any particular theory of why the aluminum alloy of the invention, anodized in accordance with the anodizing parameters of the invention, produces such a markedly improved reflectance, particularly in the absence of copper which has, heretofore, been deemed to be an essential alloying additive for high reflectance products. However, it is speculated that the presence of copper may have a synergistic interaction with the iron-silicon present in the prior art alloys to deleteriously affect the amount of reflectance attainable with prior art processes. In the present invention, the chemical bright dip step, which responds well to the presence of copper in an alloy, need not be carried out to achieve the surprising results.

EXAMPLE I

To illustrate the effect of the anodizing parameters of the invention on conventional aluminum reflector alloy, a number of sheet samples of 5005 type alloy were DC anodized in a sulfuric acid bath following chemical brightening in a hot mixture of 85% phosphoric acid and 70% nitric acid in a 19:1 ratio. Various combinations of acid concentrations, current densities and bath temperatures were used. The results are shown in Table I.

TABLE I

| | Total Reflectance | | | | | |
|---|---|---|---|---|---|---|
| Sample No. | As Run (%) | Corrected Coating (1) Weight (%) | Corrected Coating (1) Thickness (%) | Conc. Acid (%) | C.D. (ASF) | Temp. (°F.) |
| 4 | 81.8 | 82.2 | 82.7 | 28 | 36 | 74 |
| 2 | 81.3 | 81.6 | 82.3 | 28 | 18 | 74 |
| 12 | 81.3 | 81.7 | 81.6 | 22 | 42 | 84 |
| 8 | 80.8 | 80.9 | 81.3 | 28 | 36 | 94 |
| 17 | 80.8 | 81.1 | 81.5 | 22 | 27 | 84 |
| 18 | 80.7 | 81.0 | 81.7 | 22 | 27 | 84 |
| 19 | 80.7 | 81.0 | 81.5 | 22 | 27 | 84 |
| 16 | 80.5 | 80.7 | 81.1 | 22 | 27 | 84 |

TABLE I-continued

| Sample No. | Total Reflectance As Run (%) | Corrected Coating (1) Weight (%) | Corrected Coating (1) Thickness (%) | Conc. Acid (%) | C.D. (ASF) | Temp. (°F.) |
|---|---|---|---|---|---|---|
| 20 | 80.5 | 80.8 | 81.5 | 22 | 27 | 84 |
| 13 | 80.4 | 80.9 | 80.7 | 22 | 27 | 67 |
| 15 | 80.4 | 80.7 | 80.8 | 22 | 27 | 84 |
| 7 | 80.3 | 80.5 | 80.8 | 16 | 36 | 94 |
| 10 | 80.1 | 80.3 | 80.5 | 32 | 27 | 84 |
| 14 | 79.4 | 79.4 | 79.8 | 22 | 27 | 101 |
| 1 | 79.2 | 79.4 | 79.8 | 22 | 12 | 84 |
| 3 | 79.2 | 79.8 | 80.8 | 16 | 36 | 74 |
| 5 | 79.1 | 79.1 | 79.1 | 16 | 18 | 94 |
| 9 | 79.1 | 79.4 | 79.4 | 12 | 27 | 84 |
| 6 | 79.0 | 78.8 | 79.2 | 28 | 18 | 94 |
| 11 | 78.7 | 78.7 | 79.2 | 22 | 12 | 84 |

(1) Since anodizing parameters produced slight differences in coating thickness and weight, reflectance values were corrected to a constant coating thickness or weight.

The above Table I shows the descending order of total reflectance values of the as-processed samples, with corrected coating weight and corrected coating thickness values correlated with the processing parameters. Since variations in anodizing parameters cause differences in coating weight or thickness that have a known effect on reflectance, it was necessary to correct the data to a constant coating weight or thickness to eliminate this variable.

It will be seen that, in every instance, where all three parameters were in the range of the invention, a total reflectance (uncorrected) of at least 79% was obtained. Furthermore, it will be noted that where one of the parameters is at the low end of the range, this may be compensated for any adjustment of one or both of the other parameters fell within the preferred ranges, the total reflectance was 81.8%.

EXAMPLE II

To further illustrate the process aspect of the invention, a number of samples similar to those used in Example I were brightened as in Example I and then DC anodized in a 32 wt. % sulfuric acid bath at various temperatures and current densities. As shown in Table II, at this acid concentration, every sample had a total reflectance of at least 81.3%.

TABLE II

| Sample No. | C.D. ASF | Temperature °F. | Total Reflectance |
|---|---|---|---|
| 30 | 12 | 67 | 81.3 |
| 21 | 27 | 67 | 81.8 |
| 24 | 30 | 67 | 81.9 |
| 25 | 36 | 67 | 81.8 |
| 26 | 45 | 67 | 82.0 |
| 27 | 54 | 67 | 82.1 |
| 28 | 63 | 67 | 82.0 |
| 29 | 72 | 67 | 82.1 |
| 32 | 30 | 55 | 81.5 |
| 33 | 30 | 60 | 81.5 |
| 34 | 30 | 67 | 81.7 |
| 37 | 30 | 74 | 81.8 |
| 39 | 30 | 84 | 81.8 |

Figure 2:
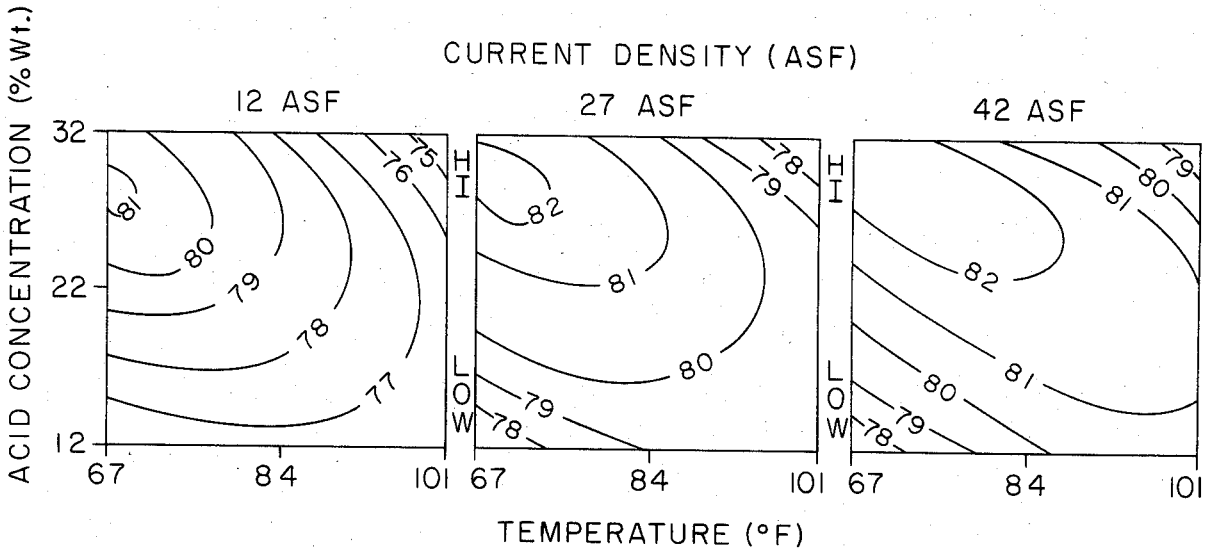
FIG. 2 is a graph having a series of curves illustrating the interrelationship between the anodizing parameters.

Based on the data produced in Examples I and II, a series of contour curves were developed, as shown in FIG. 2, to show the relationship between the three parameters of current density, sulfuric acid concentration and bath temperature to achieve the desired total reflectivity.

EXAMPLE III

To further illustrate the effect of controlling the amount of iron, silicon, copper and manganese as tolerated impurities rather than additives in accordance with the invention a series of samples A–F were prepared. All the samples were previously subjected to either bright rolling or chemical brightening, and then were anodized in accordance with the invention in 30% sulfuric acid at 74° F. for two minutes at a current density of 42 amps per square foot. The amount of iron, silicon, copper, manganese and magnesium in each sample is listed in Table III below. The 15° diffuseness percentage was measured on a Dorigon D-47 Glossmeter goniophatometer made by Hunter Labs.

Samples A and B, while showing good color diffuseness, have lower reflectance due to the higher amounts of iron in both samples as well as copper in Sample A. Samples C–F illustrate the high amount of reflectance which is theoretically attainable using aluminum with essentially no alloying ingredients. It will be noted, however, that the color diffuseness is too low in all but Sample D which contains essentially no copper or manganese, but contains 0.08% iron. In contrast, the total reflectance for Sample G, having 0.70 wt. % magnesium and essentially no iron, silicon, copper or manganese in accordance with the invention, is 84.5% with a diffuseness percentage of 0.11%.

TABLE III

| Sample No. | Other Metals Fe | Si | Cu | Mn | Mg | Total Reflectance | 15° Color Diffuseness |
|---|---|---|---|---|---|---|---|
| A | .35 | .10 | .07 | .00 | .70 | 80.0 | .53 |
| B | .35 | .10 | .00 | .00 | .70 | 81.2 | .82 |
| C | .08 | .04 | .03 | .20 | .00 | 84.5 | .04 |
| D | .08 | .04 | .00 | .00 | .00 | 85.1 | .16 |
| E | .03 | .02 | .03 | .20 | .00 | 85.2 | .02 |
| F | .03 | .02 | .00 | .00 | .00 | 86.0 | .04 |
| G | .15 | .12 | .00 | .00 | .70 | 84.5 | .11 |

Thus, the invention provides a novel anodized aluminum alloy product having high reflectance by controlling the alloying ingredients and the anodizing parameters used in producing the reflectorized product.

Having thus described the invention, what is claimed is:

1. A highly reflective anodized aluminum alloy product consisting essentially of 0.25 to 1.5 wt. % magnesium with the balance aluminum anodized in a DC anodizing bath containing at least 26% sulfuric acid at a current density of at least 18 amperes per square foot and at a temperature of at least 60° F.

2. The anodized aluminum alloy product of claim 1 wherein the amount of copper impurity in said alloy is not greater than 0.05 wt. %.

3. The anodized aluminum alloy product of claim 1 wherein the amount of manganese impurity in said alloy is not greater than 0.01 wt. %.

4. The anodized aluminum alloy product of claim 1 wherein the amount of iron or silicon impurity in said alloy is not greater than 0.5 wt. %.

5. The alloy product of claim 5 wherein said sulfuric acid concentration is from 26 to 32 wt. %.

6. The alloy product of claim 5 wherein said sulfuric acid concentration is from 28 to 32 wt. %.

7. The alloy product of claim 1 wherein said current density is from 18 to 72 amperes per square foot.

8. The alloy product of claim 7 wherein said current density is from 27 to 72 amperes per square foot.

9. The alloy product of claim 8 wherein said current density is from 30 to 45 amperes per square foot.

10. The alloy product of claim 1 wherein said temperature is from 60° to 84° F.

11. The alloy product of claim 10 wherein said temperature is from 67° to 84° F.

12. A highly reflective anodized aluminum alloy product consisting essentially of 0.65 to 0.80 wt. % magnesium with the balance aluminum, not more than 0.01 wt. % copper or manganese, not more than 0.2 wt. % iron and not more than 0.13 wt. % silicon present as impurities, anodized in a DC anodizing bath containing at least 26% sulfuric acid at a current density of at least 18 amperes per square foot and at a temperature of at least 60° F.

13. The reflective anodized aluminum alloy product of claim 12 wherein said alloy is subject to a chemical bright dip prior to said anodizing.

14. The reflective anodized aluminum alloy product of claim 13 wherein said chemically brightened alloy is etched in phosphoric acid subsequent to said chemical brightening.

15. The reflective anodized aluminum alloy product of claim 12 wherein said alloy is bright rolled prior to said anodizing.

16. A method of forming a highly reflective anodized aluminum alloy product which comprises:

(a) forming an alloy consisting essentially of 0.25 to 1.5 wt. % magnesium with the balance aluminum; and (b) anodizing said alloy in a DC anodizing bath containing at least 26% sulfuric acid at a current density of at least 18 amperes per square foot and at a temperature of at least 60° F.

17. The method of claim 16 including the further step of maintaining the amount of copper impurity in said alloy at not greater than 0.05 wt. %.

18. The method of claim 16 including the further step of maintaining the amount of manganese impurity in said alloy at not greater than 0.01 wt. %.

19. The method of claim 16 including the further step of maintaining the amount of iron or silicon impurity in said alloy at not greater than 0.5 wt. %.

20. The method of claim 16 wherein said anodizing step is carried out in a sulfuric acid bath having a concentration of from 26 to 32 wt. %.

21. The method of claim 16 wherein said anodizing step is carried out at a current density of from 18 to 72 amperes per square foot.

22. The method of claim 16 wherein said anodizing step is carried out at a temperature of from 60° to 84° F.

* * * * *